US012258177B2

(12) United States Patent
Baudtler

(10) Patent No.: US 12,258,177 B2
(45) Date of Patent: Mar. 25, 2025

(54) BEVERAGE BOTTLE AND METHOD FOR JOINING PARTS OF SAID BOTTLE

(71) Applicant: AARKE AB, Stockholm (SE)

(72) Inventor: Rasmus Baudtler, Stockholm (SE)

(73) Assignee: AARKE AB, Stockholm (SE)

( * ) Notice: Subject to any disclaimer, the term of this patent is extended or adjusted under 35 U.S.C. 154(b) by 89 days.

(21) Appl. No.: 18/004,298

(22) PCT Filed: Jun. 23, 2021

(86) PCT No.: PCT/EP2021/067108
§ 371 (c)(1),
(2) Date: Jan. 4, 2023

(87) PCT Pub. No.: WO2022/008245
PCT Pub. Date: Jan. 13, 2022

(65) Prior Publication Data

US 2023/0249875 A1 Aug. 10, 2023

(30) Foreign Application Priority Data

Jul. 8, 2020 (SE) ..... 2050863-6

(51) Int. Cl.
*B65D 23/00* (2006.01)
*B65D 1/02* (2006.01)

(52) U.S. Cl.
CPC ..... *B65D 23/001* (2013.01); *B65D 1/0261* (2013.01)

(58) Field of Classification Search
CPC .. A47G 19/2255; B65D 1/0261; B65D 15/00; B65D 23/001; B65D 23/00; B65D 25/20
USPC ..... 215/372, 376, 377, 395, 370; 220/628, 220/630, 636
See application file for complete search history.

(56) References Cited

U.S. PATENT DOCUMENTS 995,985 A 6/1911 Perry
2,905,351 A * 9/1959 Lerner ..... A47G 23/0216 220/605
3,482,724 A * 12/1969 Heaton ..... B65D 23/001 215/10
3,927,782 A * 12/1975 Edwards ..... B65D 23/001 215/10
3,952,898 A * 4/1976 Bayer ..... C08G 69/44 428/34.7

(Continued)

FOREIGN PATENT DOCUMENTS

BE 856440 A 1/1978
EP 0612667 A2 8/1994
GB 1537179 A 12/1978

OTHER PUBLICATIONS

International Search Report in PCT/EP2021/067108 dated Sep. 23, 2021.

(Continued)

*Primary Examiner* — Gideon R Weinerth
(74) *Attorney, Agent, or Firm* — Knobbe Martens Olson & Bear LLP

(57) ABSTRACT

A beverage bottle includes a beverage container part, a stand part and a connector part for connecting the stand part and the beverage container part to each other. Thread means are included for fixing the stand part and the connector part to each other. Methods for joining a beverage container part and a stand part of a beverage bottle are also provided.

13 Claims, 4 Drawing Sheets

(56) References Cited

U.S. PATENT DOCUMENTS 4,241,839 A * 12/1980 Alberghini ..... B65D 23/001 248/688
4,326,638 A 4/1982 Nickel et al.
4,552,275 A * 11/1985 Chang ..... B65D 23/001 248/346.03
4,573,597 A * 3/1986 Adams ..... B65D 23/001 220/605
4,609,418 A * 9/1986 Yoshino ..... B29C 66/5452 156/87
4,620,685 A * 11/1986 Taguchi ..... B65D 23/001 220/628
5,062,537 A * 11/1991 Hayashi ..... B65D 23/0878 40/310
5,205,423 A * 4/1993 Ota ..... B65D 23/001 220/630
6,237,801 B1 * 5/2001 Liu ..... A47G 19/2288 220/759
6,439,418 B1 * 8/2002 Immerman ..... B65D 25/24 220/636
7,467,726 B1 * 12/2008 Izraelev ..... B65D 51/249 215/396
7,574,846 B2 * 8/2009 Sheets ..... B65D 1/0261 53/368
9,022,248 B2 * 5/2015 Vandenlangenberg ..... B65D 81/3876 220/592.16
2003/0185277 A1 10/2003 Hsiao
2005/0103794 A1 * 5/2005 Liu ..... A47G 19/22 220/703
2006/0144861 A1 7/2006 Harrison et al.
2006/0163262 A1 * 7/2006 El-Saden ..... A47J 41/0016 220/592.17
2009/0050634 A1 * 2/2009 Girardot ..... B65D 23/001 220/605
2009/0050638 A1 2/2009 Smith et al.
2011/0049167 A1 * 3/2011 Martin ..... B65D 23/001 220/630
2017/0341849 A1 * 11/2017 Wolak ..... B65D 1/0261
2019/0177041 A1 * 6/2019 Walton ..... B65D 25/24
2020/0010241 A1 * 1/2020 Siegl ..... B65D 23/001
2023/0249875 A1 * 8/2023 Baudtler ..... B65D 23/001 215/372
2024/0367857 A1 * 11/2024 Ogawa ..... B65D 1/02

OTHER PUBLICATIONS

Swedish Search Report for patent application No. 2050863-6 dated Feb. 12, 2021.

* cited by examiner

BEVERAGE BOTTLE AND METHOD FOR JOINING PARTS OF SAID BOTTLE

CROSS REFERENCE TO RELATED APPLICATION

This application is a U.S. National Phase Application of PCT International Application Number PCT/EP2021/067108, filed on Jun. 23, 2021, designating the United States of America and published in the English language, which claims priority to Sweden Provisional Application No. 2050863-6, filed on Jul. 8, 2020, each of which is hereby expressly incorporated by reference in its entirety for all purposes and forms a part of this specification.

TECHNICAL FIELD

The present disclosure generally pertains to beverage bottles, and more particularly to beverage bottles for carbonators. In addition, the disclosure relates to a method for joining beverage bottle parts.

BACKGROUND ART

Carbonators are used for producing carbonated beverage, such as carbonated water. Such a carbonator, a.k.a. a soda water machine, typically comprises a carbon dioxide cylinder that is connected to a nozzle that is inserted into a beverage bottle that contains liquid.

The carbonator further comprises an operating arrangement that allows the user to open a valve in the carbon dioxide cylinder to introduce carbon dioxide into the beverage bottle. The carbon dioxide dissolves in the liquid in the beverage bottle.

Beverage bottles, in particular beverage bottles for carbonators, often comprise separate parts, sometimes made of different materials. Many prior art bottles are not durable, but may fall apart after a period of use. Prior art bottles may also comprise parts that are not tightly and securely fixed to each other. Such bottles may be perceived as flimsy, and the loosely attached parts may make the bottles difficult to handle, reduce the life and thereby not be environmentally friendly.

SUMMARY OF THE INVENTION

One object of the present disclosure is to provide a durable beverage bottle, not negatively affected by temperature changes, comprising separate parts that are tightly and securely fixed to each other. The beverage bottle shall allow the parts to be manufactured from different materials, and allow disassembly for cleaning, exchange of parts, reuse or recycle. The beverage bottle shall further be suitable for a carbonator, and easy and cost-effective to manufacture.

Such a beverage bottle is according to the present disclosure provided in form of a beverage bottle comprising a beverage container part, a stand part, a connector part for connecting the stand part and the beverage container part to each other, and thread means for fixing the stand part and the connector part to each other.

By means of the connector part, and by fixing the stand part and connector part together using threads means, the stand part and the connector part are tightly and securely fixed to each other. The separate connector part brings the advantage that the beverage stand part needs not be directly fixed to the container part, which is beneficial should different materials be used, such as a metal stand part and a plastic container part.

The connector part may allow attachment to the container part without the container part being adapted for mechanical connection, the container part need for example not comprise a particular form (e.g. threads) where the connector part is attached. This may be beneficial in particular if the container part is to contain carbonated beverage.

The thread means for fixing the stand part and the connector part to each other typically comprises first and second cooperating thread surfaces, one of which may be provided on the connector part and the other on the stand part or on a separate part. At least one of the thread surfaces may be inclined such that mutual rotation of the first and second cooperating thread surfaces results in a mutual axial movement, tightly and securely fixing the stand part and the connector part together.

Preferably, the connector part is chemically connected to the beverage container part and mechanically connected to the stand part. The connector part may comprise a first interface for chemical connection to the beverage container part. The connector part may comprise a second interface for mechanical connection to the stand part. The chemical connection may involve gluing. The mechanical connection involves the thread means. The mechanical connection allows the stand part be repeatedly releasable. The chemical connection, e.g. gluing, results in a firm and secure fixing of the connector part to the beverage container part. The chemical connection allows the beverage container part to be of a form that is suitable for containing carbonated beverage.

The connector part may be adapted to be chemically attached to the beverage container part. The connector part may for this reason be manufactured of the same, or essentially the same, material as the beverage container part. For example, the connector part and beverage container part may both be of plastic material. The connector part may be manufactured from ABS and the beverage container part may be manufactured from PET. Furthermore, the connector part may comprise a surface that is complementary in shape to the beverage container part. For example, the beverage container part may comprise a spherical surface and the connector part may comprise a concave surface. The beverage container part may advantageously be formed by blow moulding.

Preferably, the stand part is configured to be elastically deformed upon fixing the stand part and the connector part to each other. In this way, the stand part is tightly and securely fixed to the connector part. The stand part may for example comprise a portion that is elastically deformed when the thread means fix the stand part and the connector part to each other, i.e. when the thread means are mutually rotated. The elastically deformable portion may be thin-walled and made from a resilient material, such as a resilient metal, in particular resilient stainless steel. The stand part, or at least the elastically deformable portion thereof, may bias the stand part and the connector part against each other when the thread means have tightened the stand part and the connector part together.

Alternatively, or in addition, the connector part, or a portion thereof, may be configured to be elastically deformed upon fixing the stand part and the connector part to each other. The elastically deformable portion of the connector part may be made from a resilient material, such as a resilient plastic, in particular resilient ABS plastic.

The elastic deformation improves the thread means' ability to tightly fix the stand part and the connector part together in a repeatedly releasable manner.

The thread means are preferably configured such that the stand part is increasingly pressed towards the connector part upon mutual rotation of the thread means. Preferably, mutual rotation of the thread means results in the stand part and the connector part being moved towards each other and biased towards each other.

Preferably, the thread means are configured such that the stand part is not decreasingly pressed towards the connector part when the rotation reaches an end position. The thread means may be configured such that the stand part is increasingly pressed towards the connector part up until a certain rotation, and then maintained constantly pressed upon further rotation. Alternatively, the thread means may be configured such that the stand part is continuously increasingly pressed towards the connector part up until the rotation reaches an end position.

The beverage bottle preferably comprises stop means for retaining the thread means in an end position. The stop means may comprise two cooperating stop members that are adapted to engage when the thread means reaches the end position. The stop means may be configured to be resiliently engaged such that the stop members are retained engaged by a resilient force. At least one of the stop members may be resilient. For example, the stop member may be made of a resilient material. The stop member may be shaped so as to allow a resilient movement.

Preferably, the resilient stop member is arranged separately, preferably at a distance, from the thread means. The separate arrangement of the stop member allows the stop means to engage and disengage without affecting the thread means. The stand part and the connector part may then be tightly and securely fixed to each other by the thread means without any impact from the stop means. In particular, engaging the stop means will not result in the thread means less tightly and/or securely fixing the stand part and the connector part.

There may be two stop means configured such that the resilient forces are directed opposite one another. For example, the stop means may be configured such that the resilient forces between the stop members are directed radially from or towards each other and aligned with each other.

The stop means may be configured such that the resilient force that retain the stop members engaged is not aligned with the force generated by the thread means upon mutual rotation thereof. In this way, the force generated by the thread means is not impacted by the force that retain the stop members engaged. The force of the stop members may be directed in the radial direction. The force of the thread means may be directed in the axial direction. The axial direction is in this disclosure the direction in which the stand part and the connector part are moved towards or away from each other by mutual rotation of the thread means.

The thread means may comprise first and second cooperating thread surfaces wherein the connector part comprises the first thread surface and the beverage bottle further comprising a lock part that comprises the second thread surface. The lock part may also comprise one of the stop members.

The lock part part, or a portion thereof, may be configured to be elastically deformed upon fixing to the connector part. The elastically deformable portion of the lock part may be made from a resilient material, such as a resilient plastic, in particular resilient ABS plastic. The entire lock part may be manufactured from resilient ABS plastic.

Portions of one or more of the stand part, the connector part, and the lock part may be configured to be elastically deformed upon fixing the parts together by the thread means. Preferably, portions of each of the three parts are elastically deformed.

The stand part and the connector part may comprise cooperating rotation-preventing means. This is particularly beneficial should there be a desire to place a gasket, e.g. an O-ring, between the stand part and the connector part or the beverage container part. It is believed beneficial to avoid a rotational movement at a contact surface provided with a gasket, and instead only allow a translative (straight axial) movement. Also, the gasket would undesirably impede a rotational movement through friction. The beverage bottle may comprise a gasket between the stand part and the connector part or the beverage container. The rotation-preventing means may be a tongue-groove connection.

The rotation-preventing means may be the above-mentioned portion of the stand part that is elastically deformed when the thread means fix the stand part and the connector part to each other. Said portion thus advantageously serves a dual purpose.

The beverage bottle may be a beverage bottle for a carbonator, i.e. a bottle for carbonated beverage that is carbonated in the bottle. The beverage bottle for a carbonator may be configured to withstand an inner pressure of at least 20 bar.

The above object is also met by a method for joining a beverage container part and a stand part of a beverage bottle comprising the steps of A) chemically attaching a connector part to the beverage container part, B) bringing the stand part and the connector part together, and C) tightening thread means to fix the stand part to the connector part.

The advantages of the resulting beverage bottle have been discussed above. The method may involve steps corresponding to the above-mentioned features of the bottle parts. For example, step C) may be performed by rotating the stand part or by rotating a separate part, e.g. the lock part. Similarly, the connector part may be chemically attached to the beverage container part by gluing. Step C preferably involves elastically deforming the stand part and/or the connector part.

BRIEF DESCRIPTION OF THE DRAWINGS

The present invention will be described further below by way of examples and with reference to the enclosed drawings, in which.

DETAILED DESCRIPTION OF EMBODIMENTS

The disclosed embodiments will now be described more fully hereinafter with reference to the accompanying drawings. Like numbers refer to like elements throughout the description and drawings.

Figure 1:
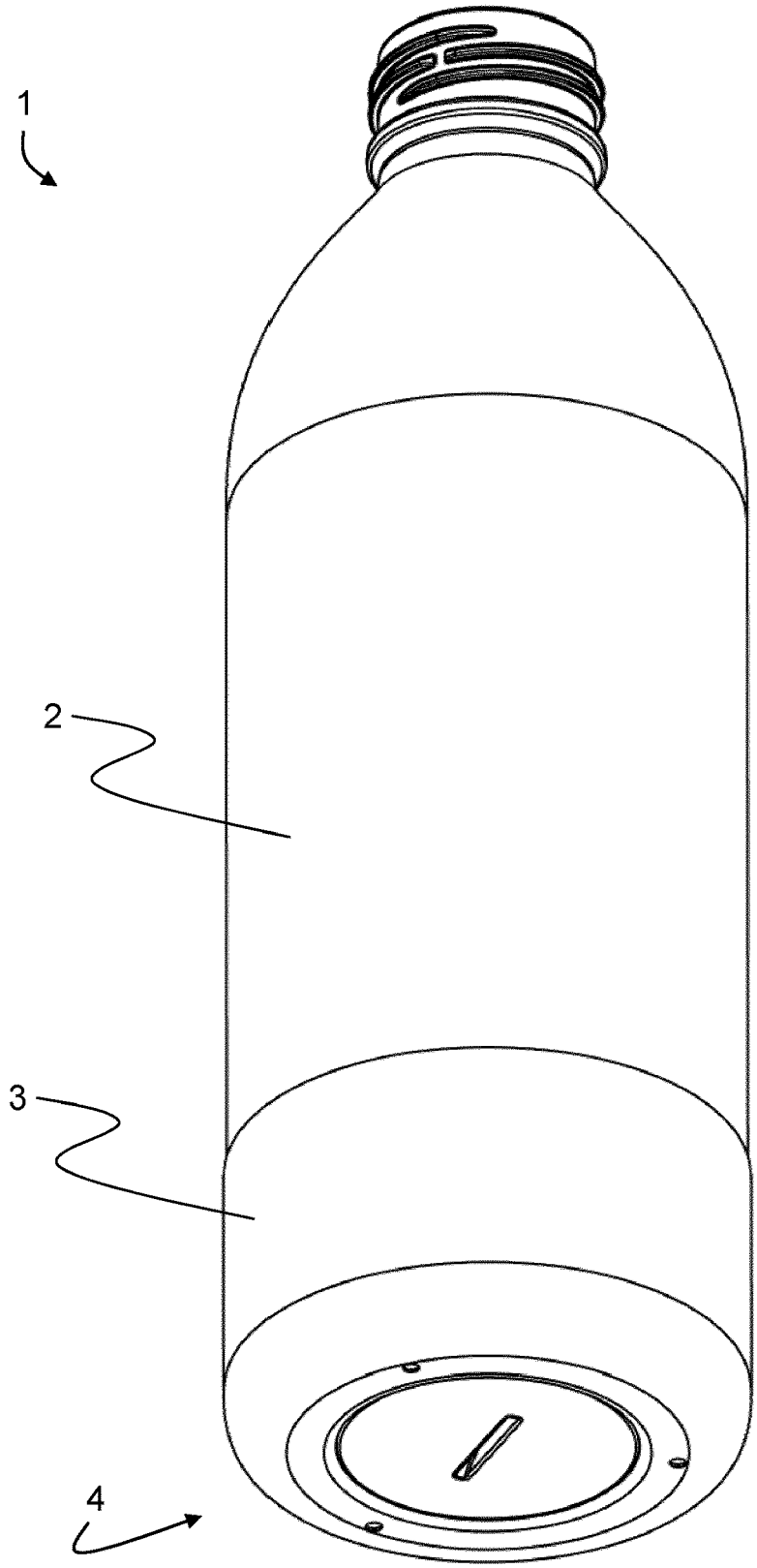
FIG. 1 shows a beverage bottle 1.
Figure 2:
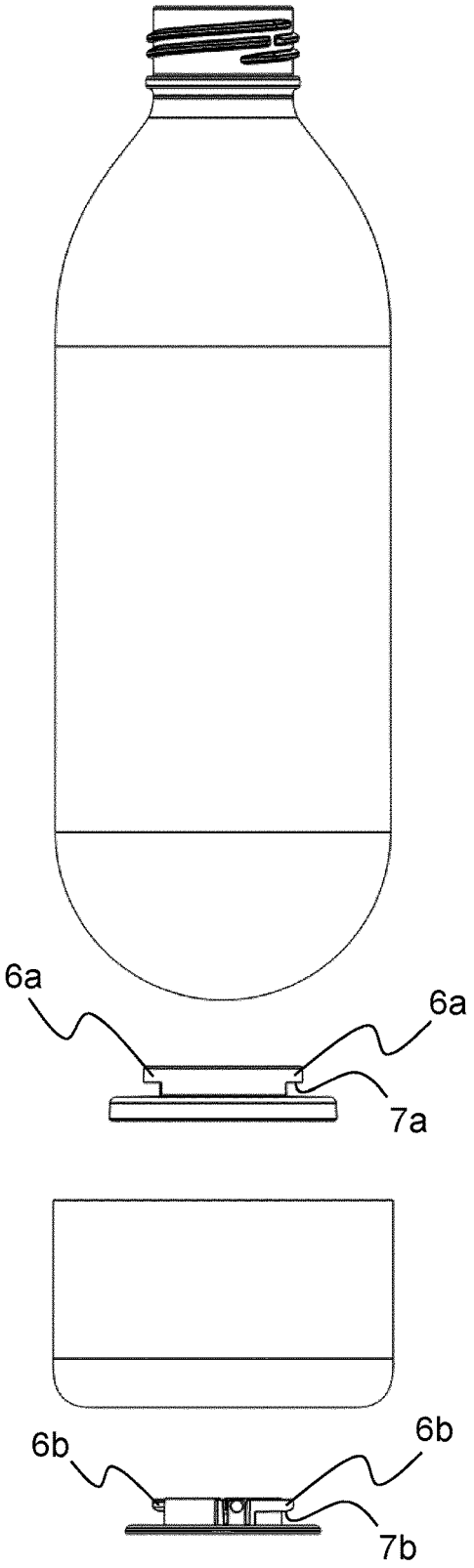
FIG. 2 is an exploded side view of the beverage bottle 1 of FIG. 1, showing a beverage container part 2, a stand part 3, a connector part 4 and a lock part.
Figure 3:
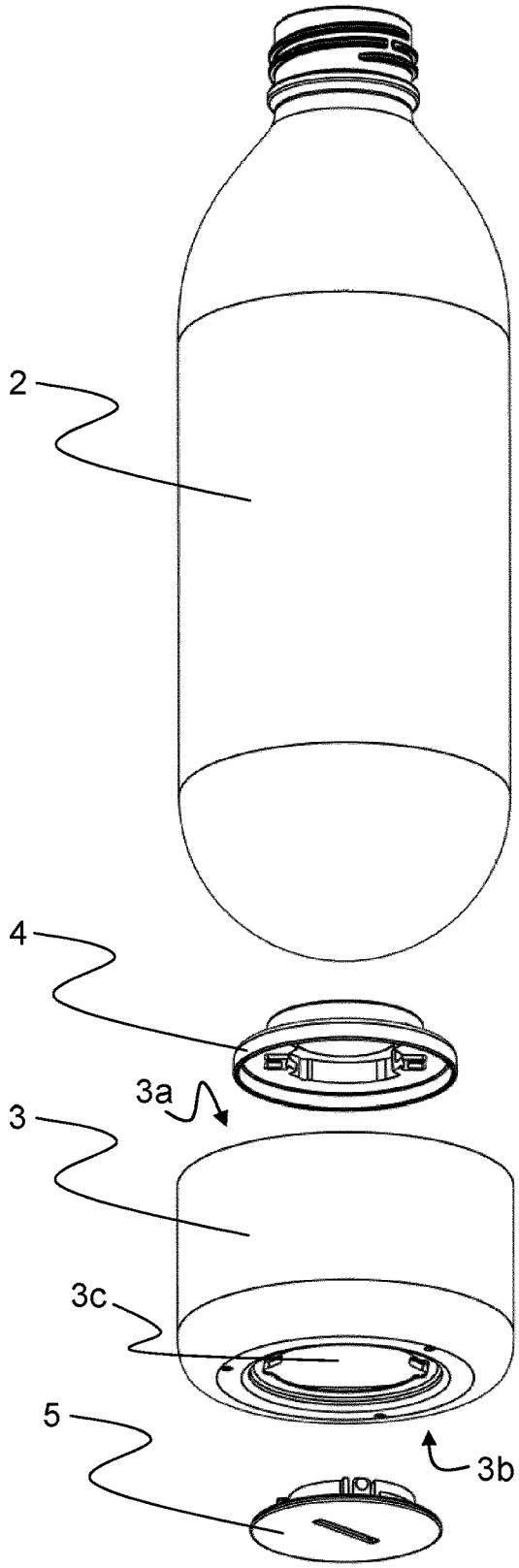
FIG. 3 is a perspective view of the parts of FIG. 2.

FIG. 1 shows a beverage bottle 1 for a carbonator, and FIGS. 2 and 3 show the same bottle 1 in exploded views. The beverage bottle 1 comprises a plastic beverage container part 2 that is intended to hold a beverage. The beverage container part 2 comprises a threaded mouth that can be sealed with a screw cap (not shown). The beverage bottle 1 may be connected to a carbonator by the threads on the mouth or by means of the flange or collar provided beneath the threads. The beverage container part 2 is preferably made of PET plastics, manufactured by blow-moulding and comprises a rounded, more precisely semi-spherical, bottom part as is shown in FIGS. 2 and 3.

Figure 5:
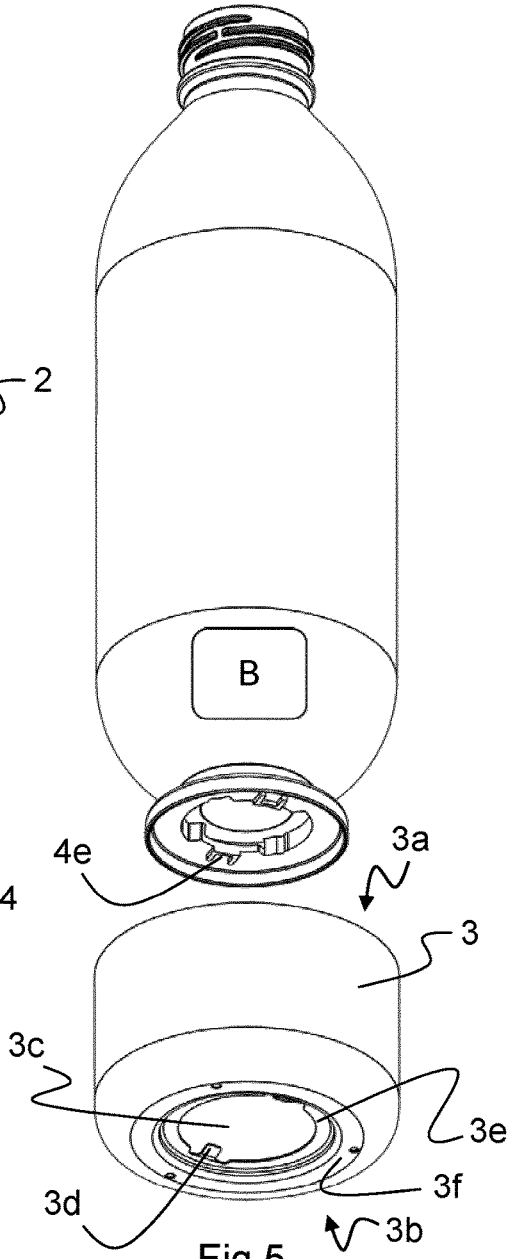

The beverage bottle 1 further comprises a stand part 3, preferably of metal, shown in more detail in FIG. 5. The stand part 3 is here cup-shaped and thin-walled with an open top 3*a* and bottom 3*b* furnished with a central stand part opening 3*c*. A flat, ring-shaped stand surface 3*f* is provided on the stand part bottom 3*b*, on which stand surface 3*f* the beverage bottle 1 is intended to stand. In this example, the metal is resilient stainless steel albeit other metals such as e.g. aluminium are also conceivable.

The bottom 3*b* of the stand part 3 is indented centrally, which means that the edge 3*e* of the stand part opening 3*c* is raised from the stand surface 3*f* Two tongues 3*d*, opposing each other, protrude radially inwards from the edge 3*e* of the stand part opening. The tongues 3*d* are inclined axially upwards, towards the beverage container part 2 when assembled.

It is not ideal to glue a metal stand part to the plastic beverage container part 2 as a metal-to-plastic glue joint may be negatively affected by stresses that result from temperature changes that the beverage bottle 1 may be affected to. Such a metal-to-plastic glue joint may further degrade over time or as a result of impacts.

When the beverage container part 2 is manufactured by blow-moulding, it would from a manufacturing standpoint be challenging to form integral mechanical fitting means for a stand part in one piece with the beverage container part 2. Also, the wall of the beverage container part 2 shall preferably be of even thickness with no sharp corners, in order to withstand high internal pressures. Such a beverage container part 2 is of a form that is suitable for containing carbonated beverage.

Figure 8:
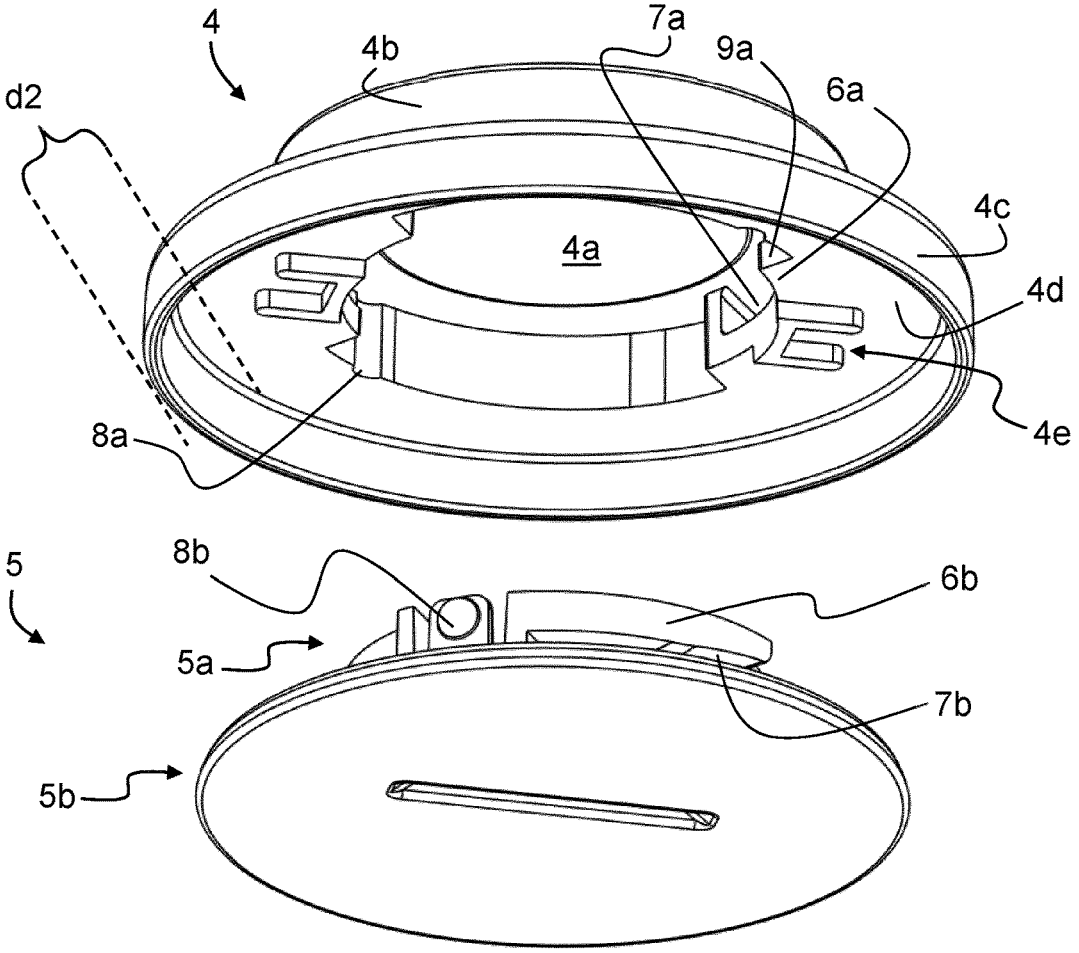
Figure 9:
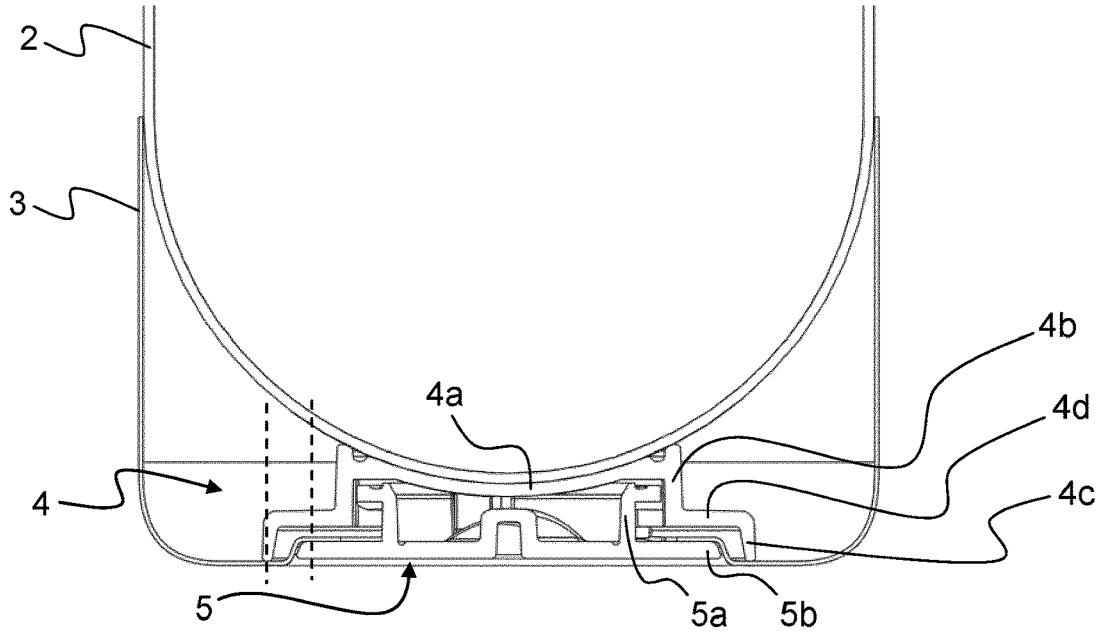
FIG. 9 illustrates a cross-section through the bottom part of the beverage bottle of FIG. 1.

A plastic connector part 4, shown in more detail in FIGS. 8 and 9, is provided for connecting the beverage container part 2 and the stand part 3 to each other. The connector part 4 comprises a top concave disc 4*a*, an upper cylindrical element 4*b*, a lower cylindrical element 4*c* and a ring-shaped disc 4*d*. The upper cylindrical element 4*b* protrudes axially from an upper side (the side facing the beverage container part 2) of the ring shaped disc 4*d* and the lower cylindrical element 4*c* protrudes axially from a lower side (the side facing away from the beverage container part 2) of the ring shape disc 4*d*. The upper cylindrical element 4*b* has a smaller diameter than the lower cylindrical element 4*c*. The upper and lower cylindrical elements 4*b*, 4*c* are of essentially the same height, i.e. extension in the longitudinal direction of the beverage bottle 1 when assembled. The diameter of the upper cylindrical element 4*b* equals the inner diameter of the ring-shaped disc 4*d*, and the diameter of the lower cylindrical element 4*c* equals the outer diameter of the ring-shaped disc 4*d*.

The connector part 4 is glued to the bottom of the plastic beverage container part 2. The concave disc 4*a* is complementary in shape to the spherical bottom of the beverage container part 2 to ensure a secure glue joint, in this example a plastic-to-plastic glue joint. The connector part 4 comprises a first interface 4*a* configured to chemically attach the connector part 4 to the beverage container part 2.

The connector part 4 is mechanically connected to the stand part 3. The lower cylindrical element 4*c* comprises a bottom surface, in this example a ring shaped surface, that is intended to abut against the stand part 3. The ring-shaped disc 4*d*, more precisely the bottom surface thereof, comprises two grooves 4*e*, arranged opposing each other on either side of the opening through the ring-shaped disc 4*d*. The grooves 4*e* cooperate with the tongues 3*d* of the stand part 3 to form a rotation-preventing connection.

The connector part 4, more precisely the upper cylindrical element 4*b* and the ring-shaped disc 4*d*, comprises connector part threads 6*a* and connector part stop members 8*a*. As can be seen (see e.g. FIGS. 2 and 8) there are two radially opposing connector part threads 6*a* and two radially opposing connector part stop members 8*a*. The connector part stop members 8*a* are here formed as cut-outs in the inner edge surface of the upper cylindrical element 4*b* and in the ring-shaped disc 4*d*.

The connector part threads 6*a* comprise connector part thread surfaces 7*a* that in this example are parallel with the radial direction, or lie in a radial plane, and thus not inclined. In other embodiments, the connector part thread surfaces 7*a* may be inclined with respect to the radial direction. The connector part threads 6*a* end in a connector part counter surface 9*a* that forms a radial stop surface.

Figure 7:
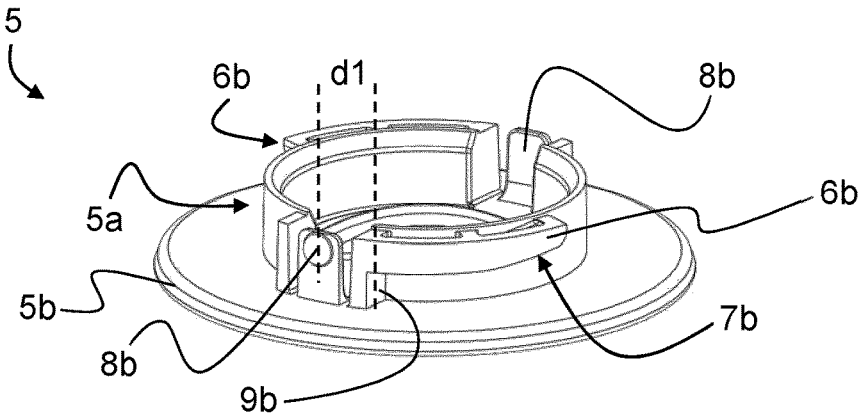
FIGS. 7-8 shows the lock part 5 and the connector part 4 in more detail.

A plastic lock part 5, shown in more detail in FIGS. 7-9, may be provided for fixing the stand part 3 and the connector part 4 to each other. By the term fixing is meant that the parts are securely attached to one another with no play. The lock part 5 and the connector part 4 are adapted to clamp the stand part 3 between them. As the connector part 4 is glued to the beverage container part 2, the stand part 3 will be fixed to the beverage container part 2.

The lock part 5 comprises a disc-shaped bottom part 5*b* from which a cylindrical portion 5*a* protrudes axially. The cylindrical portion 5*a* forms lock part threads 6*b* with lock part counter surfaces 9*b* and separately arranged lock part resilient stop members 8*b*. There are two radially opposing lock part threads 6*b*. There are two radially opposing lock part resilient stop members 8*b*. The bottom side of the disc-shaped bottom part 5*b* is furnished with a slot that can be engaged by e.g. a coin or a screwdriver to rotate the lock part 5, see especially FIGS. 8 and 9.

The lock part threads 6*b* are formed as circumferential thread bodies protruding radially from the cylindrical portion 5*a* outer wall. Each resilient stop member 8*b* can be said to be formed by two cut-outs in the cylindrical portion 5*a*, which allows the stop members 8*b* to elastically deform in the radial direction. As is illustrated by the dashed lines in FIG. 7, each resilient stop member 8*b* is provided at a distance dl from the adjacent lock part thread 6*b*, more precisely from the counter surface 9*b* thereof. The resilient stop members 8*b* are formed as beam elements that extend in the axial direction from the disc-shaped bottom part 5*b*.

The resilient stop members 8*b* are configured to be elastically deformable in the radial direction, whereas the lock part threads 6*b* are configured to convert a rotational movement into an axial movement. The resilient stop members 8*b* elastically deform independently from the lock part threads 6*b*. As shown in FIG. 7, the lock part threads 6*b* comprise lock part thread surfaces 7*b* that operationally face the axial direction whereas the resilient stop members 8*b* operationally face the radial direction.

In other known thread connections with stop means that may be engaged for retaining the connection in an end position, the stop means are typically integrated in a thread surface of the thread connection and elastically deformed or moved in the axial direction of the thread connection. As a result, the axial force obtained by the thread connection decreases slightly after such stop means have been engaged.

In the present example, the stop means are not integrated in the thread surfaces 7*a*, 7*b* and the lock part 5 is not decreasingly pressed towards the connector part 4 when the mutual rotation reaches an end position. In addition, the present resilient stop member 8*b* is not deformed in the axial direction. In an alternative embodiment, a stop member may be provided as a radial protrusion on the lock part thread 6*b* and the lock part thread 6*b* be elastically deformable in the radial direction. The thread means of the present example functions similar to a bayonet-fitting, but with no decrease in the axial force at the end position, e.g. after the stop means have been engaged.

FIG. 7, and in particular FIG. 8, illustrate that the lock part thread surfaces 7*b* comprise a first section (to the right in FIG. 8) that is inclined with respect to the radial direction, and a second section (to the left in FIG. 8) that is parallel with the radial direction. Such a configuration results in the lock part, and thus the stand part, being increasingly pressed towards the connector part up until a certain mutual rotation, and then maintained constantly pressed upon further rotation. In other embodiments, each lock part thread surface 7*b* may be continuously inclined with respect to the radial direction. Then the pressure will be continuously increasingly upon rotation.

Figure 4:
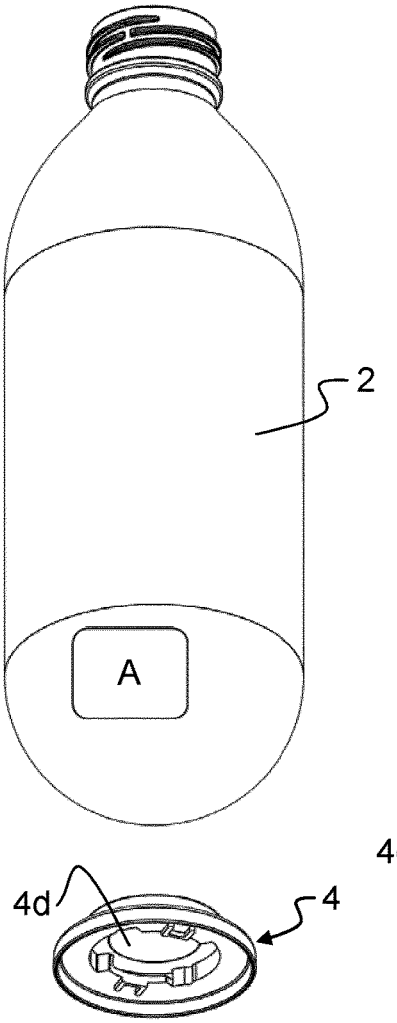
FIGS. 4-6 illustrates a method A, B, C of joining the parts of FIGS. 2 and 3.
Figure 6:
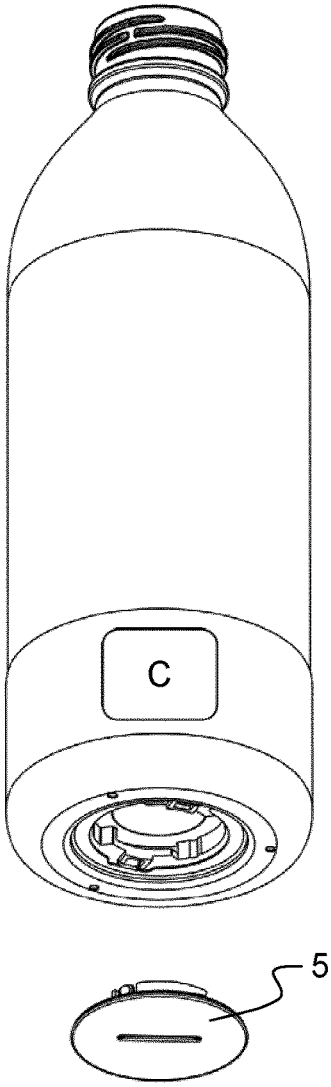

FIGS. 4 to 6 illustrate a method A-C of joining the beverage container part 2, the stand part 3, the connector part 4 and the lock part 5.

In a first step A, the connector part 4 is chemically attached by gluing to the beverage container part 2. This step involves adding a glue to the top surface (concave disc 4*a*) of the connector part 4 or to the bottom of the beverage container part 2 and then bringing the connector part 4 and the beverage container part 2 together. The glue is preferably UV hardening and the connector part 4 is for this reason preferably translucent to allow the ultra violet light to pass through. In this example, the connector part 4 is made of ABS plastic. Step A may thus involve exposing the glue joint to UV light.

In a second step B, the stand part 3 is brought to the connector part 4, and the tongues 3*d* and grooves 4*e* are engaged to provide a rotation-preventing connection. By means of the cooperating tongues 3*d* and grooves 4*e*, the stand part 3 cannot rotate with respect to the beverage container part 2.

In a third step C, the lock part 5 is screwed into the connector part 4 by engaging the connector part threads 6*a* and the lock part threads 6*b*. In this step, the stand part 3 is fixed to the connector part 4, and thus to the beverage container part 2.

As has been described, in the present embodiment the lock part thread surfaces 7*b* are inclined with respect to the radial direction whereas the cooperating connector part thread surfaces 7*a* are not inclined. In other embodiments, the connector part thread surfaces 7*a* are at least partially inclined whereas the lock part thread surfaces 7*b* are not, or both 7*a*, 7*b* are inclined. The connector part 4 comprises a second interface configured to mechanically attach the connector part 4 to the stand part 3.

The diameter of the stand part opening 3*c* is smaller than the diameter of the lower cylindrical element 4*c* of connector part 4. The diameter of the lower cylindrical element 4*c* falls in the range of the inner and outer diameters or the ring-shaped stand surface 3*f*, such that the lower cylindrical element 4*c* abuts internally against the inner side of the stand surface 3*f*. The cylindrical portion 5*a* of the lock part 5 has a smaller diameter than the stand part opening 3*c* and thus passes there through and is then screwed into the connector part 4. The diameter of the disc-shaped bottom part 5*b* is slightly smaller than the lower cylindrical element 4*c*, such that the disc-shaped bottom part 5*b* may be brought inside the lower cylindrical element 4*c* (when the lock part 5 and the connector part 4 are screwed together) to lie against the ring-shaped disc 4*d*. The diameter of the disc-shaped bottom part 5*b* and the outer diameter of the ring-shaped disc 4*d* are essentially the same.

As the connector part threads 6*a* and the lock part threads 6*b* are increasingly engaged when the lock part 5 is rotated in relation to the connector part 4, the lock part 5 and the connector part 4 move axially closer to one another and increasingly clamp the stand part 3 between them. In this process, the tongues 3*d* are axially resiliently bent until they end up aligned in parallel with the plane of the edge 3*e* of the stand part opening 3*c*.

Thus, the stand part 3 is clamped, and firmly held, between the lock part 5 and the connector part 4. The stand part 3 is particularly firmly held since the tongues 3*d* are elastically deformed as the stand part 3 is clamped between the lock part 5 and the connector part 4. More precisely, the tongues 3*d* are clamped between the disc-shaped bottom part 5*b* and the ring shaped disc 4*d* of the connector part 4. At the same time, the inner side of the stand surface 3*f* abuts against the lower cylindrical element 4*c*.

As is illustrated by the dashed lines is FIGS. 8 and 9, there is a distance d2, extending both radially and axially, between the areas where the lower cylindrical element 4*c* abuts against the stand part 3 and where the disc-shaped bottom part 5*b* abuts against the stand part 3. This distance d2 increases the portion of the stand part 3 that is elastically deformed and is beneficial for firmly clamping the stand part 3. Referring to FIG. 9, the lock element 5 presses the thin-walled stand part 3 axially upwards (towards the beverage container part 2) whereas the lower cylindrical element 4*c* presses the thin-walled stand part 3 axially downwards in a radially outer region.

In addition, the lock element, in particular the disc-shaped bottom part 5*b*, may be elastically deformed and thus assist in clamping the stand part 3. This is obtained by the central portion of the disc-shaped bottom part 5*b* being pulled towards the connector part 4 by the cylindrical portion 5*a* (provided with the lock part threads 6*b*) while the outer peripheral portion of the disc-shaped bottom part 5*b* is pushed away from the connector part 4 by the lower cylindrical element 4*c*. The disc-shaped bottom part 5*b* is thus warped.

When the mutual rotation of the lock part 5 and the connector part 4 reaches an end position, at which position the counter surfaces 9*a*, 9*b* abut each other, the lock part stop members 8*b* and connector part stop members 8*a* engage. More in detail, the lock part resilient stop members 8*b*, which during the mutual rotation have been elastically deformed by and slid along the inner surface of the upper cylindrical element 4*b*, now spring back out radially into the receiving connector part stop members 8*a*. The cooperating lock part stop members 8*b* and connector part stop members 8*a* hinder the lock part 5 from being screwed in the reverse direction out from the connector part 4. However, if a sufficiently large rotational force is applied to the lock part 5, the lock part resilient stop members 8*b* will elastically deform radially inwards and leave the connector part stop members 8*a*. The mechanical attachment of the stand part to the connector part is thus repeatedly releasable.

Thread means can be defined as means that upon mutual rotation around an axis causes an axial movement along that axis. In other words, thread means convert a rotational movement into a translative movement.

The beverage bottle 1 is intended to be used with a carbonator. Such bottles 1 are repeatedly subject to high internal pressures. For this reason, the bottle 1, or more precisely the beverage container part 2, is preferably configured for use with a carbonator which implies that the beverage bottle 1 should withstand an inner pressure of at least 20 bar.

The invention claimed is:

1. A beverage bottle for carbonated beverage comprising:

a beverage container part, a stand part, and a separate threaded connector part for connecting the stand part and the beverage container part to each other, wherein the threaded connector part is adapted to be chemically attached to the beverage container part, and wherein the stand part and/or the threaded connector part is configured to be elastically deformed upon fixing the stand part and the threaded connector part to each other.

2. The beverage bottle of claim 1, wherein the threaded connector part enables the stand part to be pressed toward the beverage container part when a complimentary threaded lock part is engaged with the threaded connector part.

3. The beverage bottle of claim 2, wherein the threaded connector part is configured such that the stand part is not decreasingly pressed towards the threaded connector part when rotation of the threaded connector part and the complimentary threaded lock part reaches an end position.

4. The beverage bottle of claim 3, further comprising a stop for retaining threads of the threaded connector part in an end position.

5. The beverage bottle of claim 4, wherein the stop comprises two cooperating stop members that are adapted to engage when the threads reach the end position.

6. The beverage bottle of claim 5, wherein at least one of the stop members is resilient such that the stop members are retained engaged by a resilient force.

7. The beverage bottle of claim 6, wherein the resilient stop member is arranged separately at a distance from the thread.

8. The beverage bottle of claim 7, comprising two stops being configured such that two resilient forces are directed opposite one another.

9. The beverage bottle of claim 6, wherein the stop is configured such that the resilient force that retains the stop members engaged is not aligned with the force generated by the threads upon mutual rotation thereof.

10. The beverage bottle of claim 1, wherein the bottle further comprises a lock part comprising a complimentary mating thread to that of the threaded connector part.

11. The beverage bottle of claim 10, wherein the lock part comprises a stop member.

12. The beverage bottle of claim 1, wherein the stand part and the connector part comprise cooperating rotation-preventing means.

13. A method for joining the beverage container part and the stand part of a beverage bottle for a carbonated beverage of claim 1, comprising the steps of:

chemically attaching a connector part to the beverage container part, bringing the stand part and the connector part together, and tightening thread to fix the stand part to the connector part.

* * * * *